US009161404B2

(12) United States Patent
Wong et al.

(10) Patent No.: US 9,161,404 B2
(45) Date of Patent: Oct. 13, 2015

(54) AC LED ARRAY CONFIGURATION SWITCHING CIRCUIT TRIGGERED BY SOURCE VOLTAGE LEVEL

(71) Applicant: Huizhou Light Engine Limited, Huizhou (CN)

(72) Inventors: Siu Hong Wong, Hong Kong (CN); Wa Hing Leung, Hong Kong (CN); Kam Wah Siu, Hong Kong (CN)

(73) Assignee: Huizhou Light Engine Limited, Huizhou (CN)

( * ) Notice: Subject to any disclaimer, the term of this patent is extended or adjusted under 35 U.S.C. 154(b) by 138 days.

(21) Appl. No.: 14/052,045

(22) Filed: Oct. 11, 2013

(65) Prior Publication Data

US 2015/0102738 A1 Apr. 16, 2015

(51) Int. Cl.
*H05B 33/08* (2006.01)

(52) U.S. Cl.
CPC ..... *H05B 33/0824* (2013.01)

(58) Field of Classification Search
None
See application file for complete search history.

(56) References Cited

U.S. PATENT DOCUMENTS

| | | | | |
|---|---|---|---|---|
| 2005/0218835 | A1 | 10/2005 | Suzunaga et al. | |
| 2011/0084619 | A1 * | 4/2011 | Gray et al. | 315/185 R |
| 2011/0199003 | A1 * | 8/2011 | Muguruma et al. | 315/122 |
| 2012/0299490 | A1 * | 11/2012 | Lee et al. | 315/191 |

FOREIGN PATENT DOCUMENTS

| | | | |
|---|---|---|---|
| CN | 102065610 | A | 5/2011 |
| CN | 102113409 | A | 6/2011 |
| CN | 102804926 | A | 11/2012 |
| CN | 103118464 | A | 5/2013 |

OTHER PUBLICATIONS

Search Report dated Nov. 7, 2013 for Chinese Patent Application No. 201310535843.7.

* cited by examiner

*Primary Examiner* — Douglas W Owens
*Assistant Examiner* — Dedei K Hammond
(74) *Attorney, Agent, or Firm* — Schiff Hardin LLP

(57) ABSTRACT

An LED lighting circuit where the configuration of the connection of two or more LEDs are changed from parallel to series through the use of solid state switches depending on whether the voltage level from an AC source measured by a voltage detector exceeds the sum of the forward voltages of the LEDs. Also, a method of activating LEDs in an LED array lighting apparatus involving applying a rectified alternating current to two or more LEDs, each LED having a forward bias voltage; comparing the rectified alternating current to the sum of the forward bias voltages of the two or more LEDs; and changing the circuit configuration of the two or more LEDs between a parallel connection and a series connection with respect to the rectified alternating current depending on whether the rectified alternating current exceeds the sum of the forward bias voltages of the two or more LEDs.

16 Claims, 13 Drawing Sheets

AC LED ARRAY CONFIGURATION SWITCHING CIRCUIT TRIGGERED BY SOURCE VOLTAGE LEVEL

TECHNICAL FIELD OF THE INVENTION

The present invention relates to using switches to change a light emitting diode ("LED") army configuration depending on the level of the source voltage. More specifically, the configuration of the connection of two or more LEDs are changed between parallel and series through the use of solid state switches depending on whether the voltage level from a rectified AC source measured by a voltage detector exceeds the sum of the forward voltages of the LEDs.

BACKGROUND OF THE INVENTION

Typically, for alternating current ("AC") powered lights, the use of LEDs requires a current limiting device to regulate the current through the LEDs and maintain a constant light output. FIG. 1 is a schematic of a conventional AC LED circuit. The LEDs can be driven directly by the AC power source, for example, a 90 VAC to 135 VAC or 207 VAC to 253 VAC source. In this example, LED strings D1 and D2 are connected in parallel with reverse connections so that only one of the LEDs is biased on during each half cycle. Although schematically only one LED is shown, it is known that the LEDs may he a string or array of LEDs.

The operation of the circuit of FIG. 1 is shown in FIG. 2. Source voltage 202 is a sinusoidal wave form having a positive half cycle and a negative half cycle. During the positive half cycle, LED string D2 is reverse biased and when source voltage 202 exceeds the forward voltage of LED string D1, LED string D1 conducts and emits light during the time shows in area 204. During the negative half cycle of scarce voltage 202, LED string D1 is reverse biased and when source voltage 202 exceeds the forward voltage of LED String D2, LED string D2 conducts and emits light during the time shown in area 206. In this example, the forward voltages of LED strings D1 and D2 are equal and resistors R1 and R2 limit the current through the LED strings D1 and D2 linearly. However, the sinusoidal AC line voltage turns off the LED strings at a rate of double the line frequency. As can be seen in FIG. 2, the LED string on-time is about 40%.

FIG. 3 shows the schematic of an LED string powered by a rectified AC voltage with a linear current source regulating the LED current. AC power source 302 provides a sinusoidal input to bridge rectifier 304. The rectified voltage is then applied to power current source 306 and to forward bias LED string 308. LED string 308 is forward biased only when the output of bridge rectifier 304 exceeds the sum of the forward voltages of LED string 308. FIG. 4 shows a graphical depiction of rectified voltage 402 and the on time for LED string 308 shown by the high signals of curve 404. Similar to the circuit of FIG. 1, this circuit turns off the LED string at a rate of double the line frequency. The LED string on-time is about 40 to 50%.

To retain the simple design of linear mode power supplies for LED arrays while improving the efficiency and reducing light off-time, manufacturers have come up with the idea of powering only part of the LED string when the source voltage is not high enough to turn on the whole LED string. FIG. 5 shows an example of a linear LED driver to drive three LED strings. AC power 502 applies AC power, which is rectified by bridge rectifier circuit 504. Integrated circuit 506, in this example the commercially available integrated circuit AIC6600, contains a voltage detector that is used to control the turning on and turning off of the LED strings based on the detected voltage level of input voltage. At lower input voltage levels, integrated circuit 506 activates main LED string 508 and does not activate LED strings 510 and 512. At higher voltage levels, integrated circuit 506 turns on main LED string 508 and LED strings 510 and 512. This is shown in the graph of FIG. 6 which shows rectified voltage 602 compared with the on-time for the LED strings. During the initial rise in rectified voltage 602, when the voltage level does not exceed the forward voltage of main LED string 508, none of the LED strings are active as indicated by segment 604. When rectified voltage 602 exceeds the forward voltage of main LED string 508, main LED string 508 is powered as indicated by segment 606, with LED strings 510 and 512 being off. When rectified voltage 602 exceeds a second threshold level, main string 508 and LED string 510 are active as indicated by segment 608. When rectified voltage 602 exceeds a third threshold level, main LED string 508, LED string 510 and USD string 512 are active as indicated by segment 610. The number of LEDs in the LED strings is dependent on the voltage level of the AC power source. It can be seen that the LED on-time is increased to 85% with the circuit in FIG. 5. However the usage of LED strings is not even, LED Main String 508 is turned on more often than LED strings 510 and 512, which may cause a difference in the lifetimes of the LED strings.

Therefore, it is with respect to these considerations and others that the present invention has been made.

SUMMARY OF THE INVENTION

One embodiment of the invention is an LED array lighting apparatus powered by a rectified voltage having a pair of LEDs, each having a forward bias voltage, first and second current drivers, three solid state switches configured such that in a first state the pair of LEDs are connected in parallel to the rectified voltage and are driven by the first current driver, and in a second state the pair of LEDs are connected in series to the rectified voltage and are driven by second current driver, and a voltage detector for comparing the rectified voltage against the sum of the forward bias voltages of the pair of LEDs, the voltage detector causing the three solid state switches to enter the first state when the rectified voltage is below the sum of the forward bias voltages of the pair of LEDs and the voltage detector causing the three solid state switches to enter the second state when the rectified voltage is above the sum of the forward bias voltages of the pair of LEDs.

In another embodiment of the invention, the LEDs have equal forward voltages, the solid state switches are single pole double throw switches, or the pair of LEDs are each an array of LEDs. The voltage detector may contain a zener diode with a zener voltage equal to or greater than the sum of the forward bias voltages of the pair of LEDs.

Yet another embodiment of the invention is an LED array lighting apparatus powered by a rectified voltage having two or more LEDs, each having a forward bias voltage, first and second current drivers, solid state switches configured such that in a first state at least two of the LEDs are connected in parallel to the rectified voltage and are driven by the first current driver and in a second state at least two of LEDs are connected in series to the rectified voltage and are driven by the second current driver, and a voltage detector toggling the solid state switches between the first and second states based on the rectified voltage being either below or above the sum of the forward bias voltages of the at least two LEDs. The LEDs have unequal forward voltages, the solid state switches are single pole double throw switches and each of the two or more LEDs are each an array of LEDs. The LEDs may be driven by a first current driver and in the second state, the LEDs are driven by a second current driver. The voltage detector may contain a zener diode with a zener voltage equal to or greater than the sum of the forward bias voltages of the pair of LEDs.

Another embodiment of the invention is a method of activating LEDs in an LED array lighting apparatus comprising applying a rectified alternating current to two or more LEDs, each LED having a forward bias voltage, comparing the rectified alternating current to the sum of the forward bias voltages of the two or more LEDs, and changing the circuit configuration of the two or more LEDs between a parallel connection and a series connection with respect to the rectified alternating current depending on whether the rectified alternating current exceeds the sum of the forward bias voltages of the two or more LEDs.

BRIEF DESCRIPTION OF THE DRAWINGS

The figures are for illustration purposes only and are not necessarily drawn to scale. However, the invention itself may best be understood by reference to the detailed description which follows when taken in conjunction with the accompanying drawings in which.

DETAILED DESCRIPTION Of THE INVENTION

Various embodiments will now be described with reference to the accompanying drawings, which form a part of the description, and which show, by way of illustration, specific embodiments. However, this invention may be embodied in many different forms and should not be construed as limited to the Specific embodiments set forth herein. Rather, these embodiments are provided so that this disclosure will be thorough and complete, and will fully convey the scope of the invention to those skilled in the art. As described below, various embodiments of the invention may be readily combined without departing from the scope or spirit of the invention.

The following briefly describes the embodiments of the invention to provide a basic understanding of some aspects of the invention. It is not intended to identify key or critical elements, or to delineate or otherwise narrow the scope of the invention. Its purpose is merely to present some concepts in a simplified form.

Figure 1:
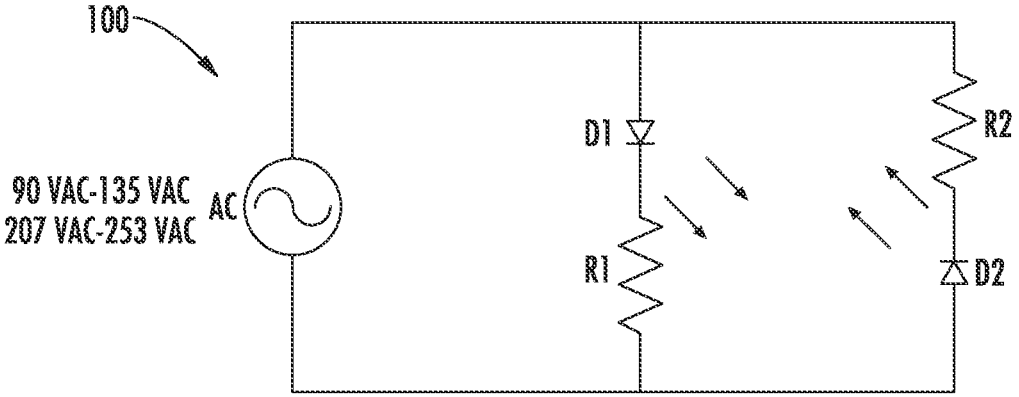
FIG. 1 (Related Art)
FIG. 1 is a schematic of a conventional alternating current LED circuit.
Figure 2:
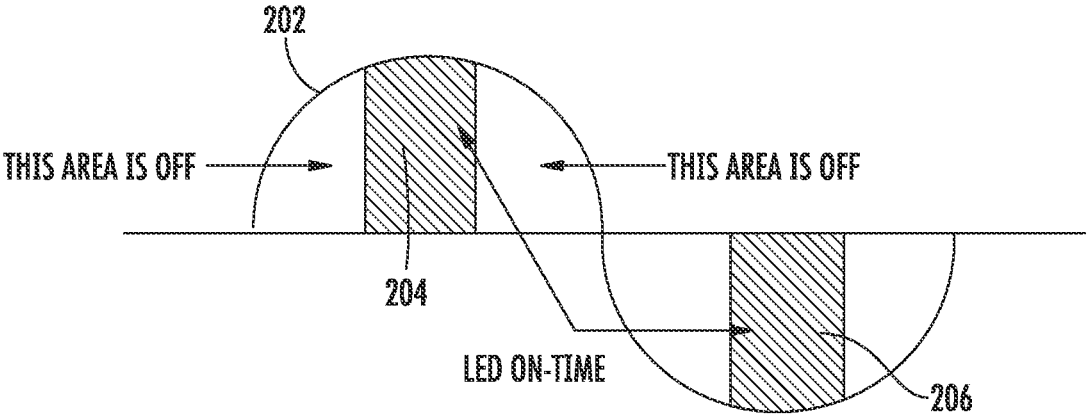
FIG. 2 (Related Art)
FIG. 2 is a graphical depiction of the applied voltage and LED on-time for the circuit of FIG. 1.
Figure 3:
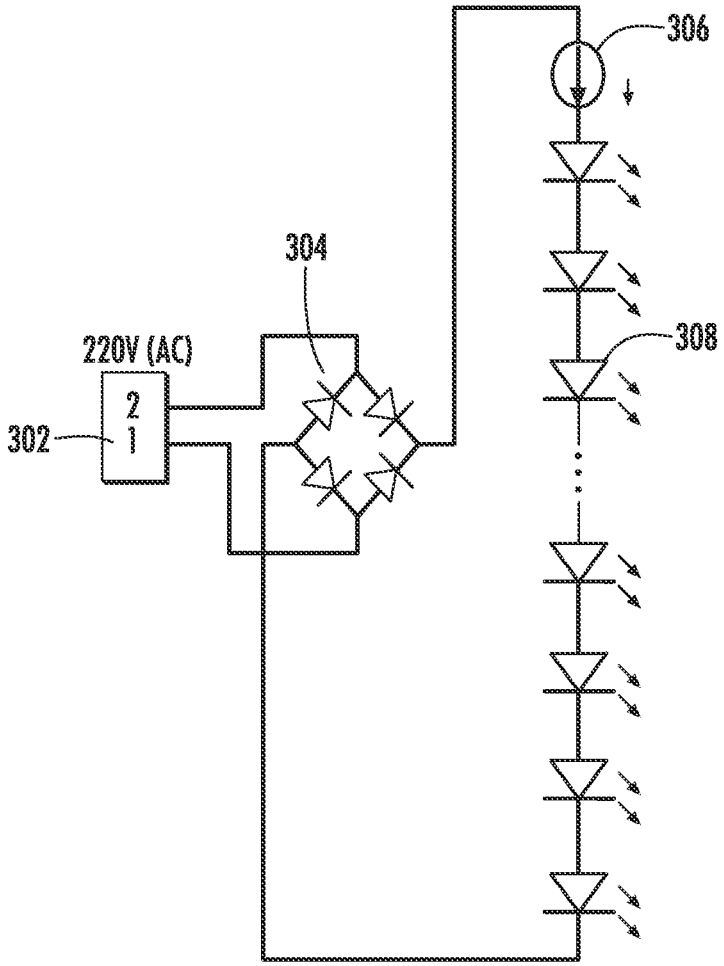
FIG. 3 (Related Art)
FIG. 3 shows a conventional schematic of an LED string powered by a rectified AC voltage with a linear current source regulating the LED current.
Figure 4:
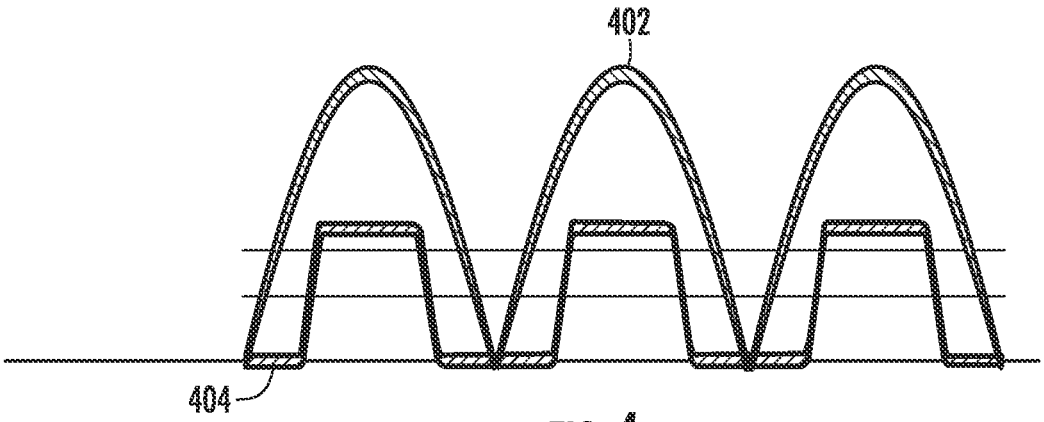
FIG. 4 (Related Art)
FIG. 4 shows a graphical depiction of the applied voltage and LED on-time for the circuit of FIG. 3.
Figure 5:
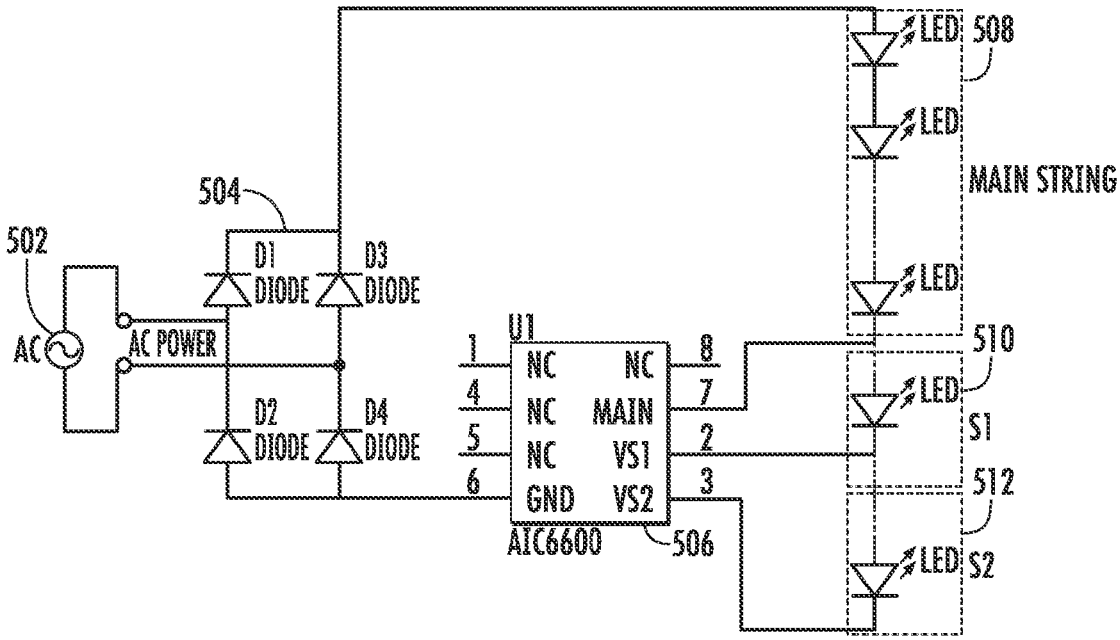
FIG. 5 (Related Art)
FIG. 5 is a schematic of an LED driver using an integrated circuit to drive three LED strings.
Figure 6:
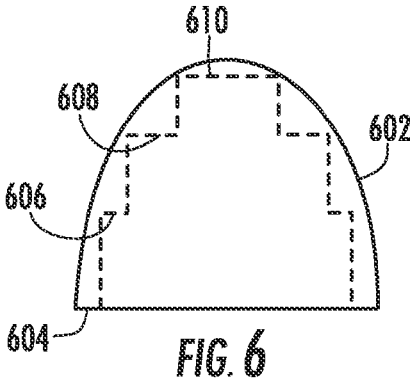
FIG. 6 (Related Art)
FIG. 6 show a graphical depiction of the applied voltage and LED on-time the circuit of FIG. 5.
Figure 7:
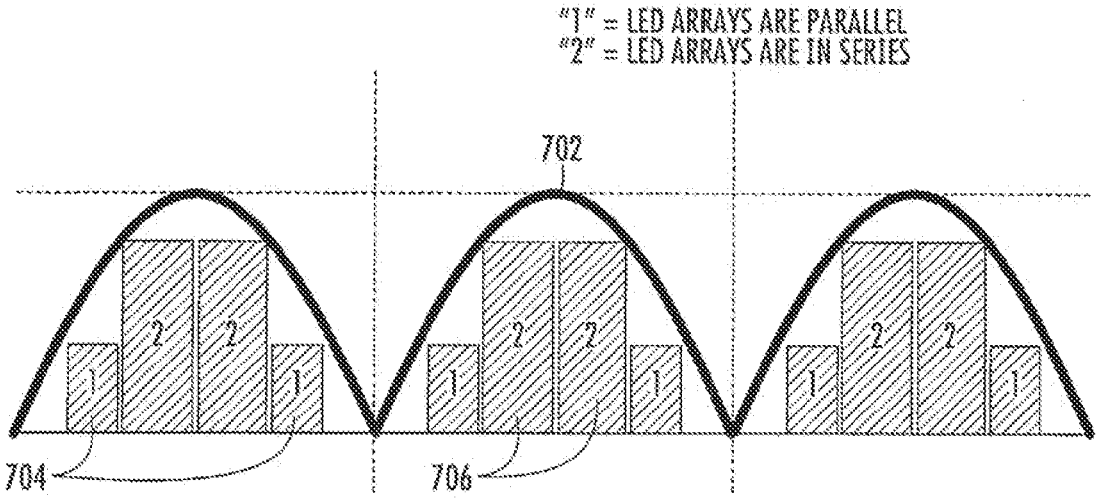
FIG. 7 is a graphical depiction of the applied voltage and LED on time for one embodiment of the present invention.

One embodiment of the invention uses LED strings with equal forward voltages, where the connection of the LED strings is changed from series to parallel in accordance with the voltage level of the rectified sinusoidal input voltage. In the instance where there are two LED strings with the same forward voltage, when the rectified sinusoidal input voltage is lower than twice the forward voltage of the two LED strings, the two LED strings are configured to be connected in parallel and the current though them is controlled by a linear current source. When the input voltage is exceeds twice the value of forward voltage, the circuit is reconfigured such that the two LED strings are connected in series and the LED current is controlled by another linear current source. This is shown conceptually in FIG. 7. In FIG. 7, rectified voltage 702 is a rectified sinusoidal voltage curve. When rectified voltage 702 is less than the LED string forward voltage, no LED string is turned on. As rectified voltage 702 increases and exceeds the forward voltage of the LED string, the circuit is configured such that the two LED strings are connected in parallel and driven by a linear current source as indicated by the numbers "1" in sections 704. When the voltage curve reaches twice the value of the forward voltage of one of the LED strings, the circuit is then reconfigured such that the two LED strings are connected in series and driven by a second linear current source as indicated by the numbers "2" in sections 706. Although in this embodiment the LED strings have equal forward voltages, alternatively the forward voltages may be unequal.

Figure 8A:
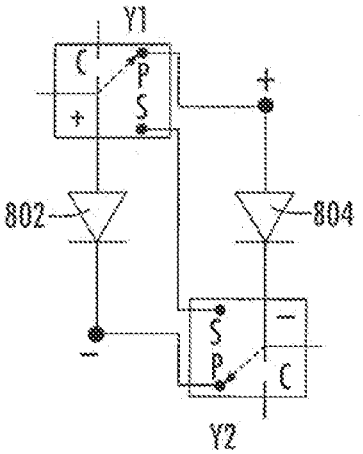
FIGS. 8A and 8B show the concept of switching between series and parallel connections using single pole double throw switches for one embodiment of the present invention.
Figure 8B:
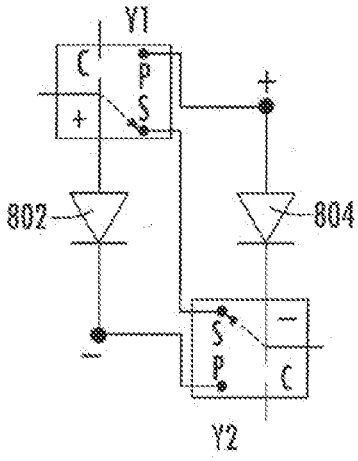

FIGS. 8A and 8B show the concept of switching between series and parallel connections using Single Pole Double Throw (SPDT) switches. FIG. 8A shows that when switches Y1 and Y2 are in the "P" position, LED strings 802 and 804 are connected in parallel with respect to the positive and negative terminals. FIG. 8B shows that when the switches are switched to the "S" position, LED strings 802 and 804 are connected in series with respect to the positive and negative terminals.

Figure 9:
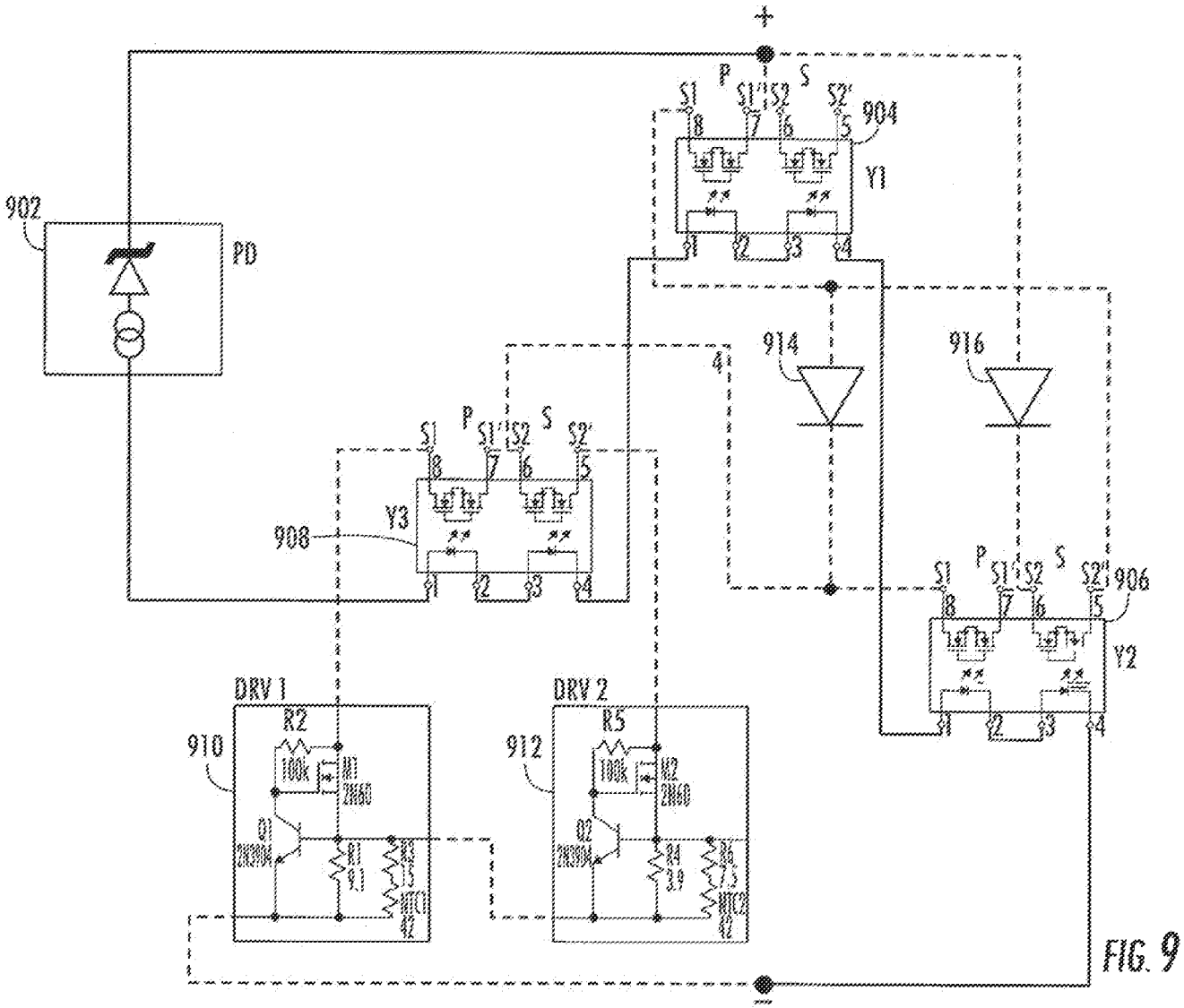
FIG. 9 shows a schematic of one embodiment of the present invention using solid-state relays as single pole double throw switches.

FIG. 9 shows an exemplary circuit of the present invention using solid state relays as single pole, double throw ("SPDT") switches. The circuit contains switches 904, 906, 908, linear current sources 910, 912 and LED strings 914, 916. Switches 904, 906 and 908 may be solid-state relays, such as the commercially available LH1502 relay by Vishay, that contain normally open and normally closed switches that can be used independently as a 1 form A and 1 form B relay, or when used together, as a 1 form C relay. Actuation control may be via infrared LED. The outputs switch is a combination of a photodiode array with MOSFET switches and control circuitry. Voltage detector 902 may consist of, in one embodiment, a zener diode and a current source. The zero diode voltage is selected to be twice the LED string forward voltage. In this embodiment, as the Input voltage increases to be above zero diode voltage, the current begins to flow through the control switches and causes the control switches to change from the "P" position to the "S" position.

Figure 9A:
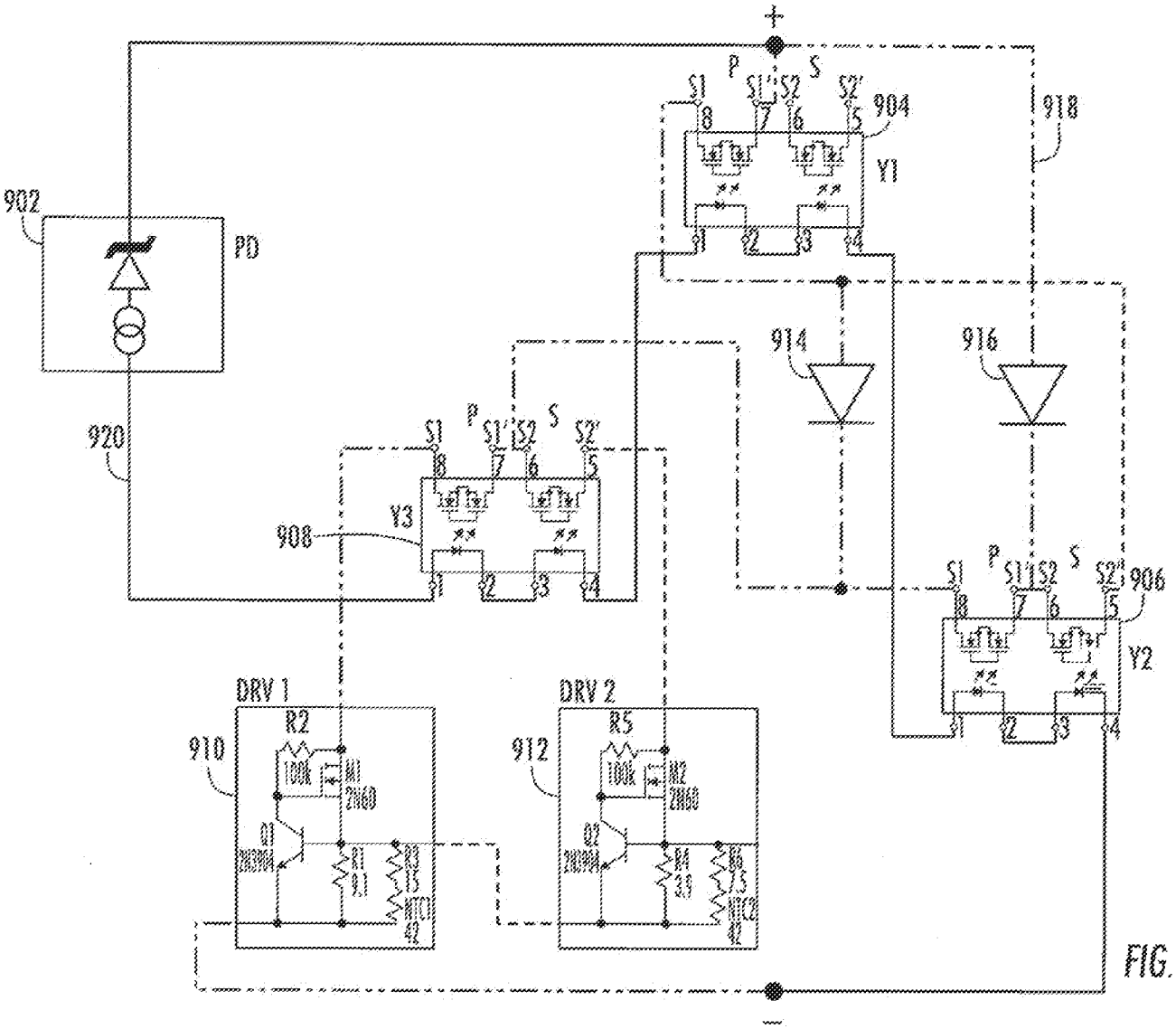
FIG. 9A shows the circuit pathways created by the single pole double throw switches in a first state of one embodiment of the present invention.
Figure 9B:
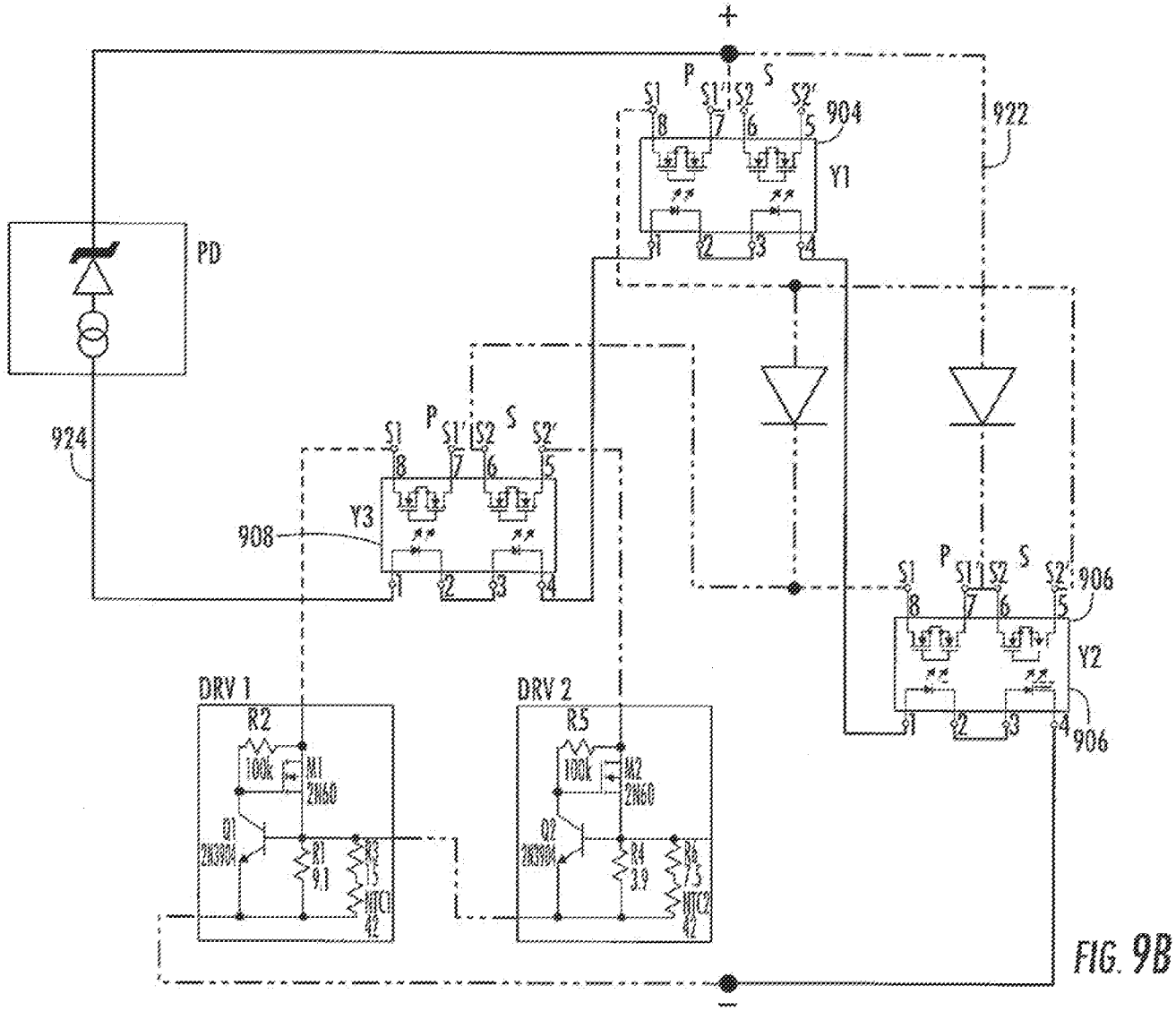
FIG. 9B shows the circuit pathways created by the single pole double throw switches in a second state of one embodiment of the present invention.

FIG. 9A shows LED current path 918 and control current path 920 when the input voltage is lower than twice the forward voltage of LED strings 914, 916. In this instance, switches 904, 906 and 908 are all in the "P" position thereby connecting LED strings 914, 916 in parallel with respect to the input voltage. FIG. 9B shows LED current path 922 and control current path 924 when the input voltage is greater than twice the forward voltage of LED strings 914, 916. In this instance, switches 904, 906 and 908 are all in the "S" position thereby connecting LED strings 914, 916 in series with respect to the input voltage.

Figure 10:
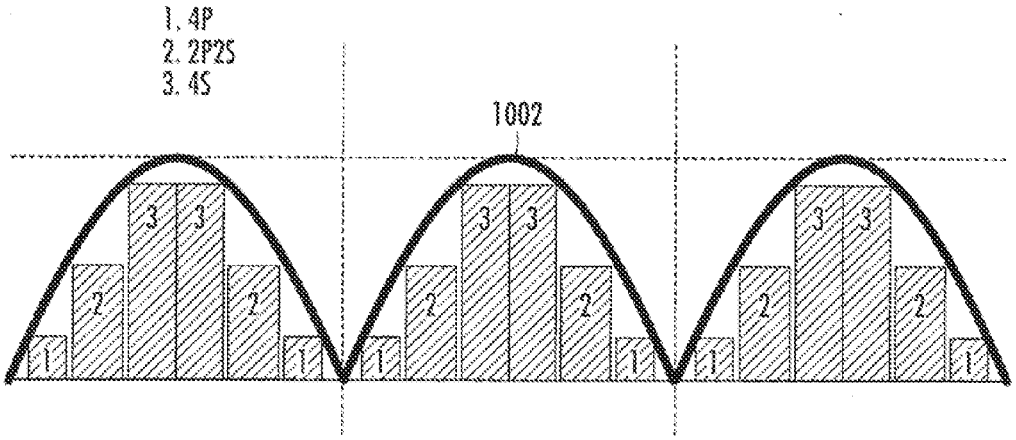
FIG. 10 is a graphical depiction of the applied voltage and LED on time for four LED strings of equal forward voltage in another embodiment of the present invention.

The parallel/series switching concept can be extended to multiples of two LED strings. FIG. 10 shows the concept of connecting 4 LED strings using the parallel/series concept where each has an equal forward voltage. The source voltage is shown as rectified voltage 1002. Initially, when rectified voltage 1002 is less than the forward voltage of the LED strings, none of the LED strings emit light. When rectified voltage 1002 exceeds the forward voltage of one of the LED strings, all 4 LED strings are connected in parallel and become active as shown by sections 1 in FIG. 10. As rectified voltage 1002 increases, in sections 2, each of the 2 LED strings are connected in parallel and then the two parallel LED strings are connected in series. In sections 3, all 4 LED strings are connected in series. It can be seen that the LED on-time is further increased to >90% with this configuration.

Figure 11A:
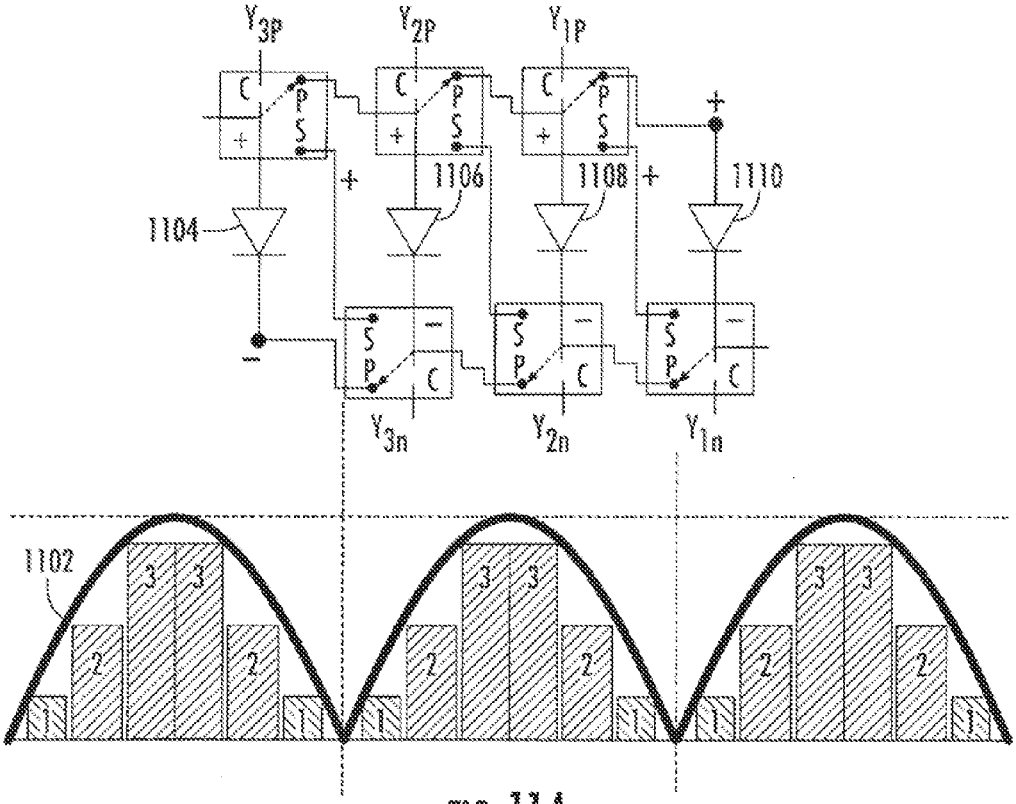
FIGS. 11A to 11C show the circuit pathways and the applied voltage and LED on time for four LED strings of equal forward voltage.
Figure 11B:
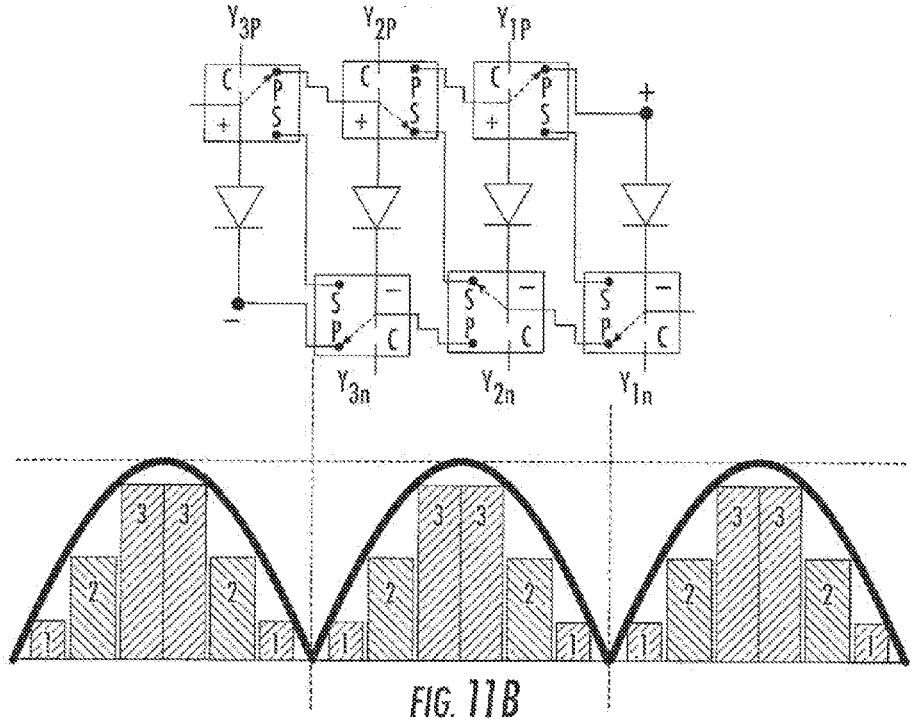
Figure 11C:
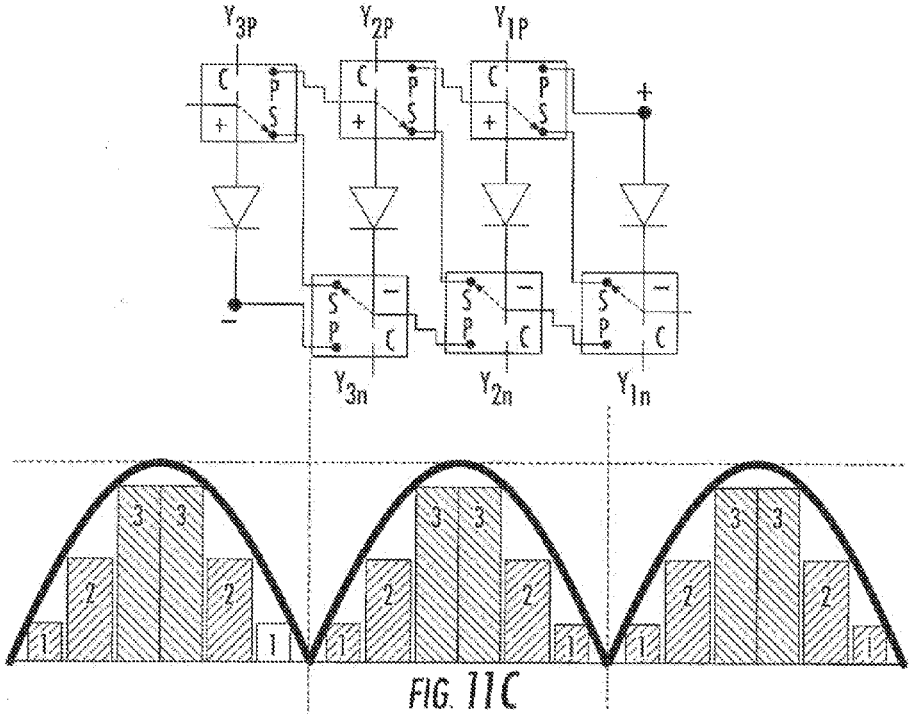

FIGS. 11A to 11C show the concept of switching between series and parallel connection using Single Pole Double Throw (SPDT) switches for four LED strings. In FIG. 11A, all of the switches are in the "P" position, causing the LED strings 1104, 1106, 1108 and 1110 to be connected in parallel with respect to the rectified voltage source. This configuration corresponds to sections 1 below the curve of rectified voltage source 1102. As rectified voltage source 1102 increases and exceeds the sum of the forward voltage of two of the LED strings, switches $Y_{2p}$ and $Y_{2n}$ are changed to the "S" position causing LED strings 1104 and 1106 to be parallel and LED strings 1108 and 1110 to be connected in parallel. However, LED strings 1104, 1106 are connected in series with LED strings 1108 and 1110. This configuration corresponds to sections 2 below the curve of rectified voltage source 1102. As rectified voltage source 1102 increases and exceeds the sum of the forward voltage of all four of the LED strings, the remaining switches are also changed to the "S" position causing all of the LED strings to be connected in series. This configuration corresponds to sections 3 below the curve of rectified voltage source 1102.

Figure 12:
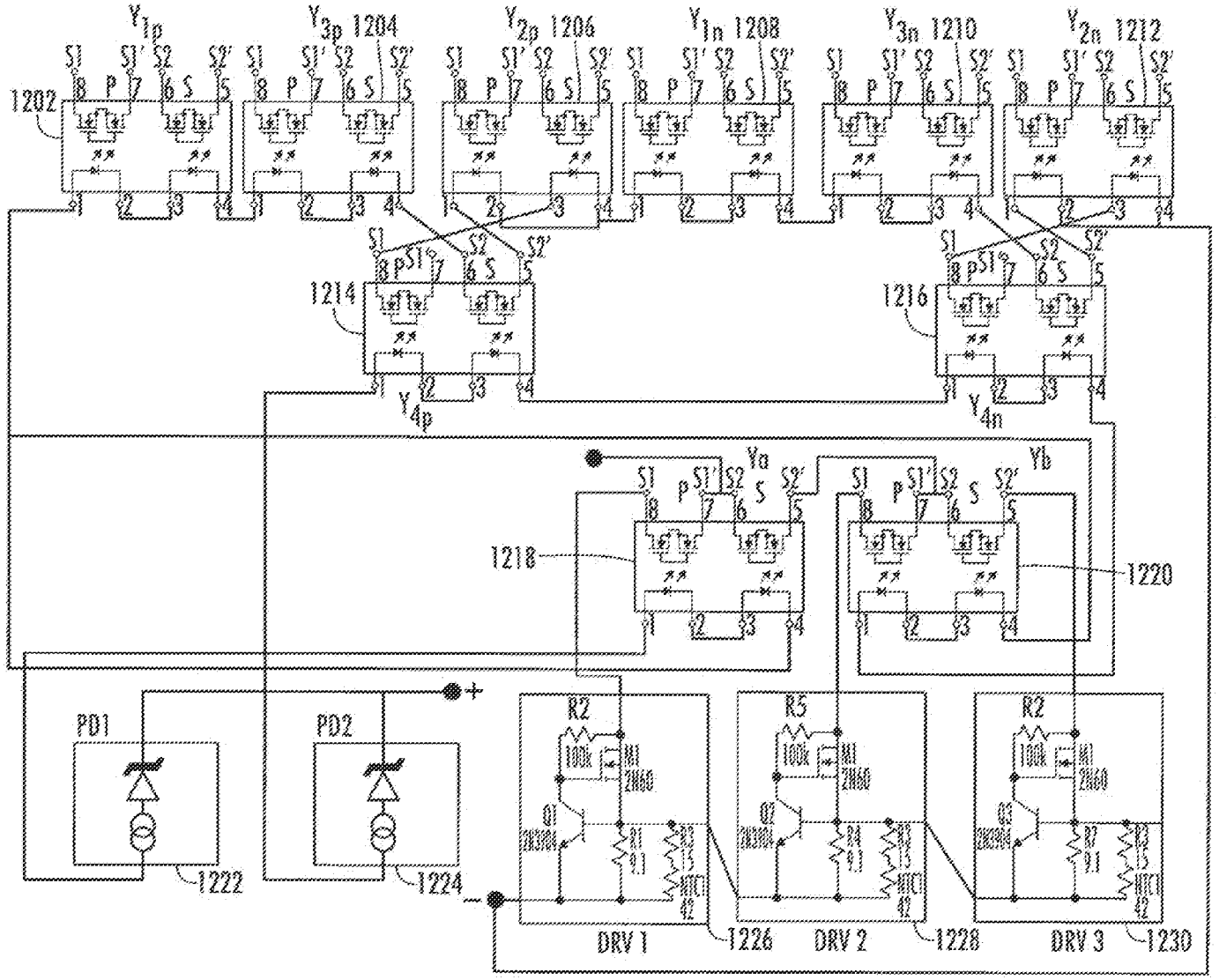
FIG. 12 shows a schematic of another embodiment of the present invention using solid-state relays as single pole double throw switches for four LED strings.
Figure 13A:
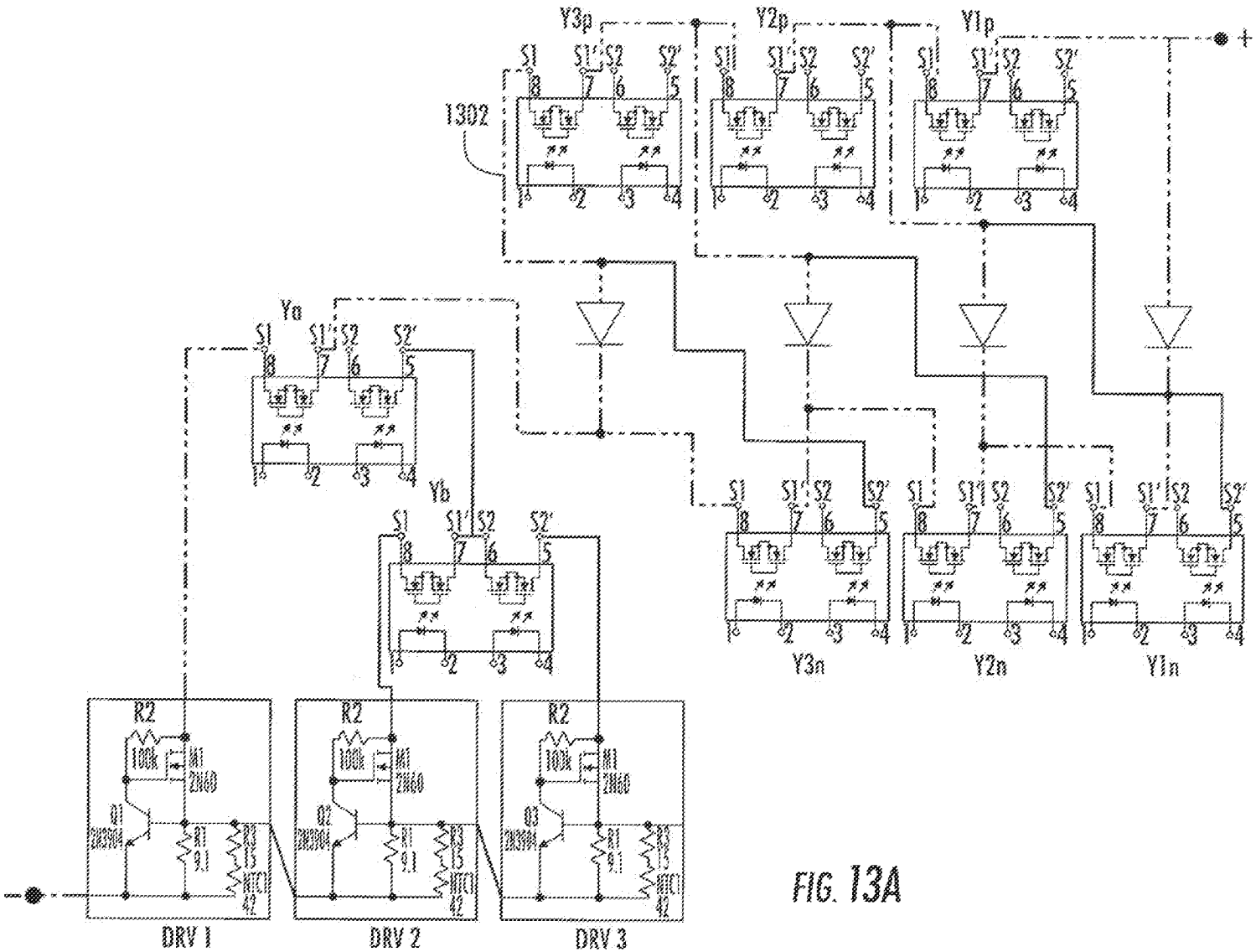
FIGS. 13A to 13C show the circuit pathways during different states of the solid state relays for four LED strings of equal forward voltage.
Figure 13B:
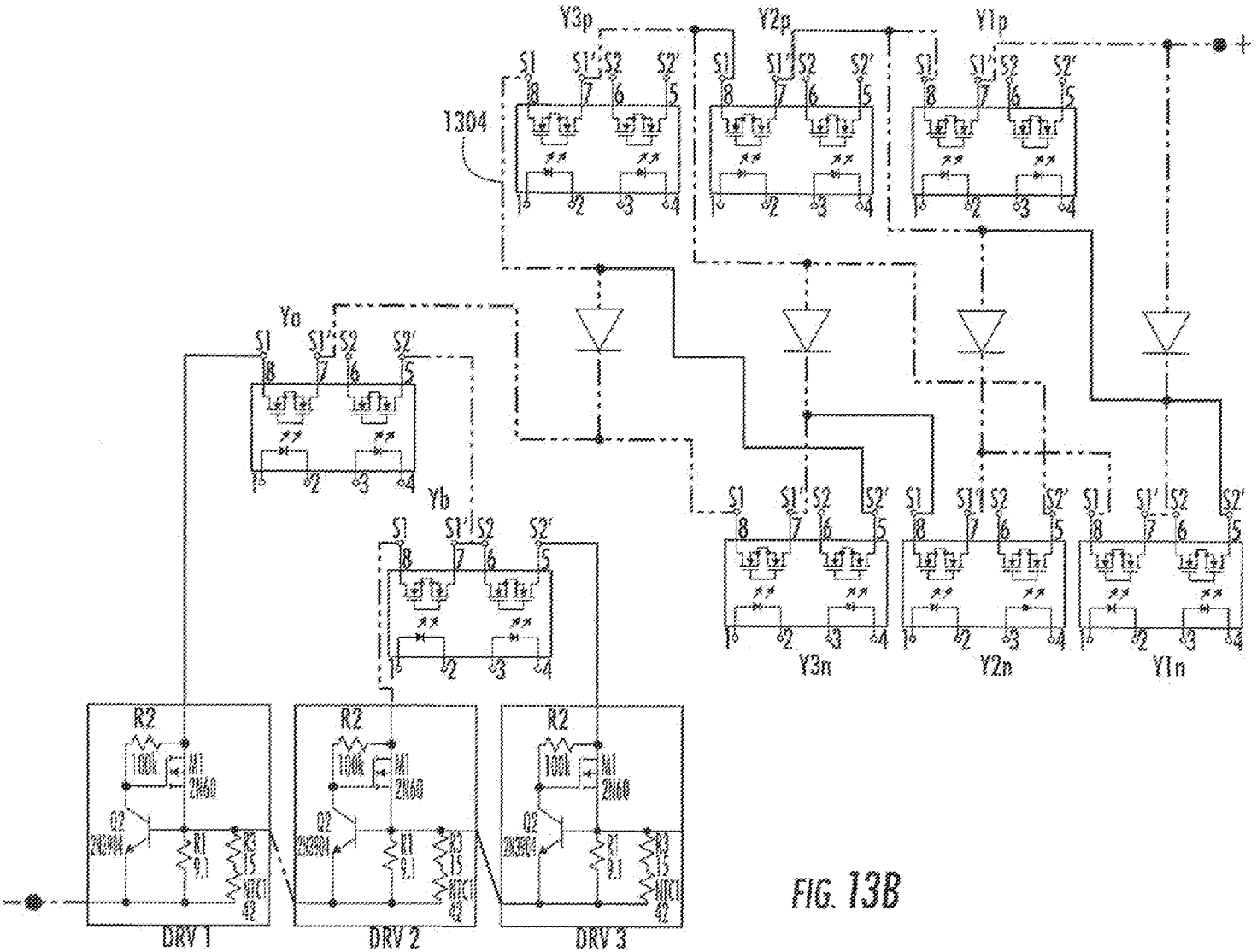
Figure 13C:
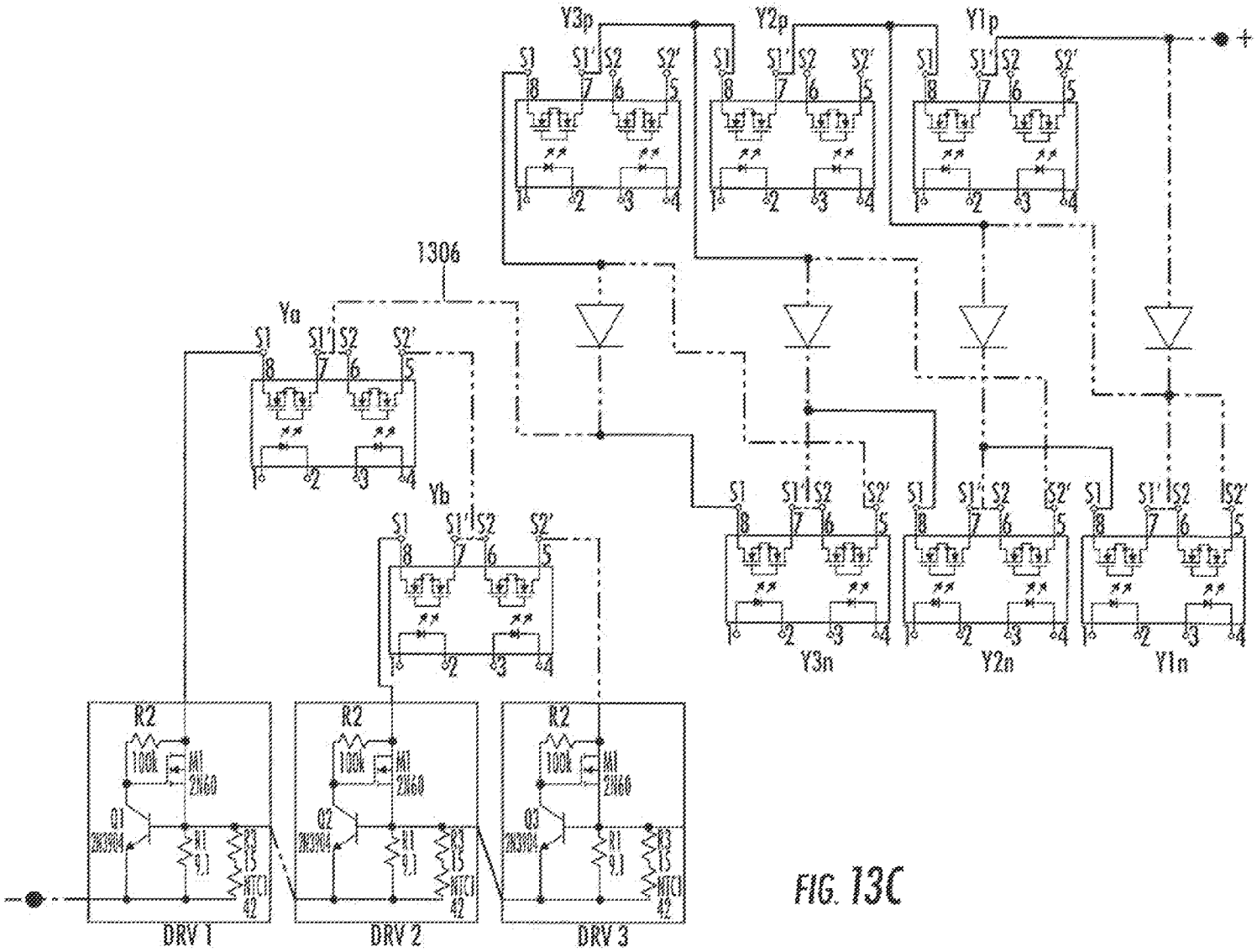

FIG. 12 shows an exemplary circuit of the present invention using solid state relays as SPDT switches for four LED strings. There are ten switches 1202 to 1220, two voltage detectors 1222, 1224 and three linear current sources 1226 to 1230. The switches and voltage detectors may, in this embodiment, operate in the same manner as described with respect to FIG. 9, FIGS. 13A, 13B and 13C show the LED current paths in the three stages of LED switching as indicated in FIG. 10. FIG. 13A shows LED current path 1302 when the rectified voltage exceeds the forward voltage of one of the LED strings and all of the LED strings are connected in parallel. FIG. 13B shows LED current path 1304 when the rectified voltage exceeds the sum of the forward voltage of two of the LED strings. In this instance, two of the LED strings are connected in parallel, and the two sets of parallel LED strings are connected in series. FIG. 13C shows the LED current path 1306 when the rectified voltage exceeds the sum of the forward voltages of all of the LED strings, in which all of the LED strings are connected in series.

Although other modifications and changes may be suggested by those skilled in the art, it is the intention of the inventors to embody within the patent warranted hereon all changes and modifications that reasonably and properly come within the scope of their contribution to the art.

What is claimed is:

1. An LED array lighting apparatus powered by a rectified voltage comprising:

a pair of LEDs, each having a forward bias voltage;

first and second current drivers;

three solid state switches configured such that in a first state the pair of LEDs are connected in parallel to the rectified voltage and are driven by the first current driver, and in a second state the pair of LEDs are connected in series to the rectified voltage and are driven by second current driver; and a voltage detector comprising a zener diode having a zener voltage equal to or greater than a sum of the forward bias voltages of the pair of LEDs, the voltage detector being configured to:

compare the rectified voltage to the zener voltage, generate, using the zener diode, a control signal based on the comparison, and control, based on the control signal, the three solid state switches to enter the first state when the control signal indicates that the rectified voltage is below the zener voltage and to enter the second state when the control signal indicates that the rectified voltage is greater than the zenor voltage.

2. The LED array lighting apparatus of claim 1, wherein the LEDs have equal forward voltages.

3. The LED array lighting apparatus of claim 1, wherein the solid state switches are single pole double throw switches.

4. The LED array lighting apparatus of claim 1, wherein the pair of LEDs are each an array of LEDs.

5. The LED array lighting apparatus of claim 1, wherein a cathode of the zener diode is connected to a positive polarity of the rectified voltage and an anode of the zener diode is connected to a negative polarity of the rectified voltage through the three solid state switches.

6. The LED array lighting apparatus of claim 5, wherein the voltage detector further comprises a current source connected between the anode of the zener diode and the negative polarity of the rectified voltage.

7. The LED array lighting apparatus of claim 5, wherein the three solid state switches are connected in series between the anode of the zener diode and the negative polarity of the rectified voltage.

8. An LED array lighting apparatus powered by a rectified voltage comprising:

two or more LEDs, each having a forward bias voltage;

first and second current drivers;

solid state switches configured such that in a first state at least two of the LEDs are connected in parallel to the rectified voltage and are driven by the first current driver and in a second state at least two of LEDs are connected in series to the rectified voltage and are driven by the second current driver; and a voltage detector comprising a zener diode having a zener voltage equal to or greater than a sum of the forward bias voltages of the two or more LEDs, the zenor diode being configured to generate a control signal based on the zener voltage and the rectified voltage, wherein the voltage detector is configured to toggle the solid state switches between the first and second states based on the control signal generated by the zenor diode.

9. The LED array lighting apparatus of claim 8, wherein the LEDs have unequal forward voltages.

10. The LED array lighting apparatus of claim 8, wherein the solid state switches are single pole double throw switches.

11. The LED array lighting apparatus of claim 8, wherein each of the two or more LEDs are each an array of LEDs.

12. The LED array lighting apparatus of claim 8, where in the first state, the LEDs are driven by a first current driver and in the second state, the LEDs are driven by a second current driver.

13. A method of activating LEDs in an LED array lighting apparatus comprising:

applying a rectified alternating current to two or more LEDs, each LED having a forward bias voltage;

comparing the rectified alternating current to a zener voltage of a zener diode to generate a control signal, the zener voltage being equal to or greater than the sum of the forward bias voltages of the two or more LEDs; and changing the circuit configuration of the two or more LEDs between a parallel connection and a series connection with respect to the rectified alternating current based on the control signal.

14. The method of claim 13 wherein the changing of the circuit configuration is through solid state switches.

15. The method of claim 14 wherein the changing of the solid state switches consist of single pole double throw switches.

16. The method of claim 13 further comprising:

driving the LEDs through a first current driver when the LEDs are connected in parallel; and driving the LEDs through a second current driver when the LEDs are connected in parallel.

* * * * *